United States Patent [19]

Amadeo

[11] 4,287,609

[45] Sep. 8, 1981

[54] PROTECTIVE HAND WRAP FOR ATHLETES

[76] Inventor: James M. Amadeo, 821 23, West Des Moines, Iowa 50265

[21] Appl. No.: 44,119

[22] Filed: May 31, 1979

[51] Int. Cl.[3] ..... A41D 13/08

[52] U.S. Cl. ..... 2/16

[58] Field of Search ..... 2/16, 20, 18; 273/54 B; 128/157, 169, 165

[56] References Cited

U.S. PATENT DOCUMENTS

| | | | |
|---|---|---|---|
| 1,706,503 | 3/1926 | Travers | 2/18 |
| 3,217,332 | 11/1965 | Gross | 2/16 |
| 3,381,304 | 5/1968 | Coco | 2/20 |

OTHER PUBLICATIONS

Tuf Wear; Division of Safe-Play, Inc., 1977, Sidney, Nebraska, P.O. Box 239, 69169.

*Primary Examiner*—Doris L. Troutman

*Attorney, Agent, or Firm*—Morton S. Adler

[57] ABSTRACT

A hand wrap is provided for athletes with particular usefulness in the sports of boxing and football for the protection of the hands, knuckles and wrists. The wrap comprises an elongated preferably two inch wide strip of flexible woven cotton twill having a first thumb engaging loop at one end from which the wrap is trained across the palm and back across the back of the hand and the knuckles to a second thumb engaging loop. Intermediate the two thumb loops and on the initial portion to traverse the knuckles there are two spaced loops for engaging respectively the index and little fingers. The remainder of the strip is wound about the hand over the knuckles with intermediate turnings about the wrist to terminate about the wrist where the other end of the wrap is provided with a self-fastening means. Padding is preferably provided in the wrap on the initial knuckle engaging portion.

23 Claims, 8 Drawing Figures

PROTECTIVE HAND WRAP FOR ATHLETES

BACKGROUND OF THE INVENTION

This invention relates to improvements in hand wrappings to protect the hands of athletes in sports such as boxing football and the like where danger of injury to the hands is present.

The use of some form of hand covering is a common expedient in many sports such as the well known full or partial gloves in baseball, tennis ang golf to facilitate gripping of the bat, racquet or club, wrapping gymnasts, U.S. Pat. No. 3,381,304 to aid in gripping the bars and protection against friction burns and coverings for protection of the hands against injury from contact inherent in the nature of the sport such as boxing and football. It is in the latter area for which the present invention is more particularly designed.

In boxing, the danger of injury to the hands, wrist and knuckles is, of course, obvious and thus it is customary for boxers to use some form of hand protection both for training and in actual contests. One type of a training glove-like covering is disclosed in U.S. Pat. No. 1,706,503 and a more common type of covering or wrap used both for training and worn under the actual boxing gloves is a long strip of flexible twill material having a single thumb loop at one end from which the remaining length is wrapped around the hand, knuckles and wrist and finally secured at the wrist by tie strings. Despite the widespread use of this latter wrapping, it has a tendency to slip and slide, to have an abrasive effect on the skin at times and in general, to not be entirely satisfactory for the full protection desired. Further, in using such a wrapping, it is generally difficult for the user to secure the tie strings with one hand so that assistance is required.

In football, as is well known, the linemen regularly wrap their hands with many turnings of surgical gauze and adhesive tape that is used but once and then discarded so that such wrappings constitute a substantial expense item.

With the above observations in mind, it is one of the important objects of this invention to provide an improved hand wrap for athletes for the protection of their hands, wrists and knuckles that eliminates the disadvantages of hand wraps presently used.

Another object of this invention is to provide a hand wrap as characterized which includes a plurality of thumb and finger engaging loop members arranged to assure that the wrapping will not be displaced from covering the area of the hand it is designed to protect.

A further object of this invention is to provide a hand wrap of the above class that is simple and easy to apply and which can be efficiently applied and secured by the user.

Still another object herein is to provide a hand wrap as described which is economical in manufacture and can be used repeatedly.

The foregoing objects and such further objects as may appear herein, or be hereinafter pointed out, together with the advantages of this invention will be more fully discussed and developed in the more detailed description of the accompanying drawings.

DESCRIPTION OF THE PREFERRED EMBODIMENTS

Figures 1, 2, 3, 4, 5, 6, 7, 8:
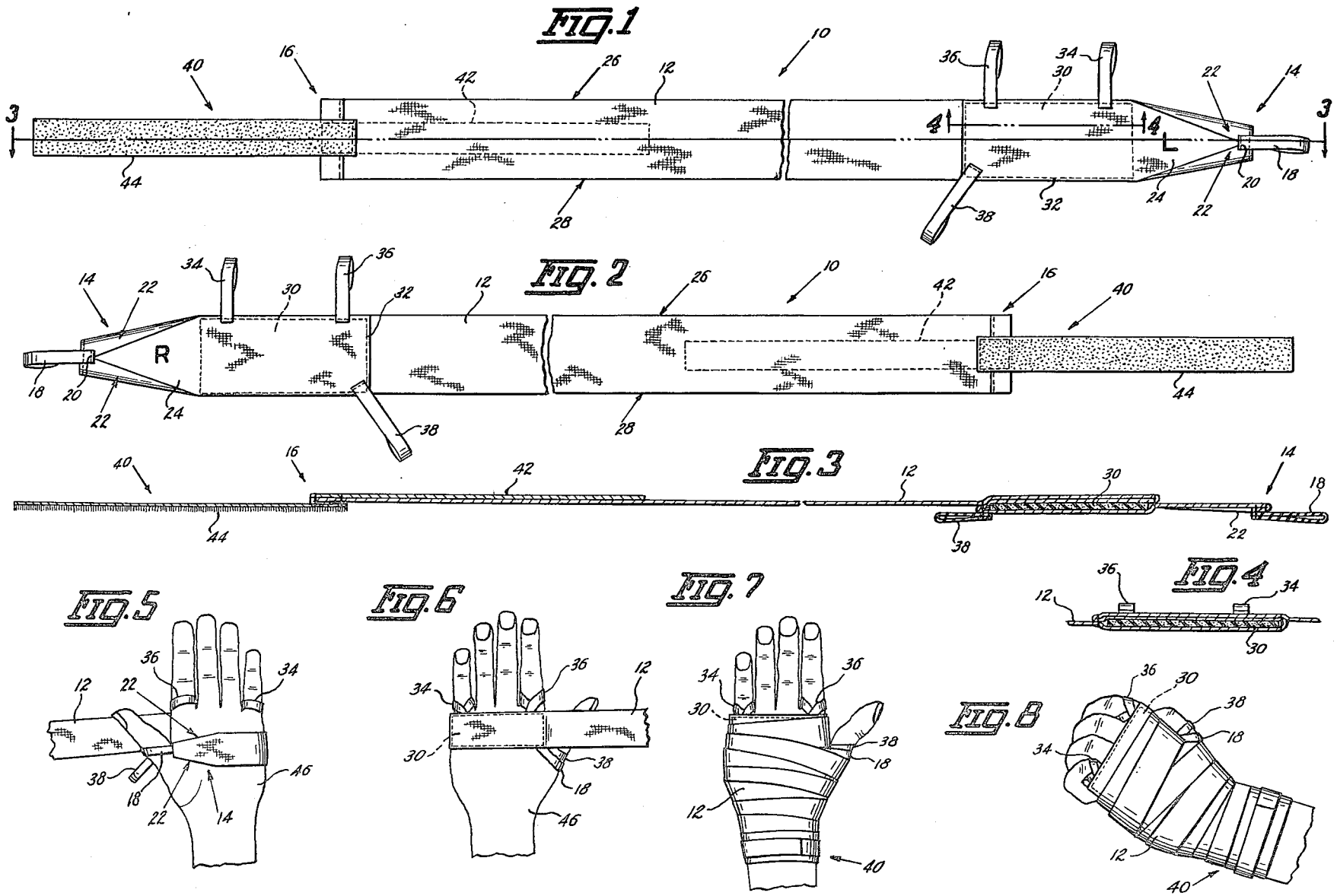
FIG. 1 is a foreshortened side elevational view of this new hand wrap as designed for the left hand.
FIG. 2 is a view similar to FIG. 1 but showing the interior thumb loop and the fastening means positioned for using this wrap on the right hand.
FIG. 3 is a longitudinal sectional view taken on the line 3—3 of FIG. 1.
FIG. 4 is a cross sectional view taken on the line 4—4 of FIG. 1, and FIGS. 5-8 are schematic hand illustrations showing the sequence of steps in applying this new hand wrap of FIG. 1 to the left hand of a user, the application of the wrap in FIG. 2 to the right hand being the same but in reverse direction.

Referring to the drawings, this new hand wrap is designated by the numeral 10 as seen in FIGS. 1 and 2 which illustrate said wrap for the respective left and right hands of the user as will later be referred to in more detail.

Wrap 10 comprises an elongated strip of flexible material 12 having the starting end 14 and the fastening end 16. Material 12 is preferably of woven cotton twill approximately two inches wide and approximately eight feet long which may be varied to provide different lengths suitable for different size hands. A first thumb loop member 18 is secured as by stitching 20 to end 14 so as to project longitudinally therefrom and, as with other loops to be later described, is preferably of a suitable resilient material such as elastic or the like. Also, preferably, the sides of material 12 at end 14 are folded in as at 22 to provide a double thickness of material at end 14 to which loop 18 is secured. The side of material 10 toward which ends 22 are folded define the inside side 24 of wrap 10 and for the left hand wrap, an imprint of the letter "L" is placed on side 24 near folds 22 as seen in FIG. 1 with an imprint of the letter "R" similarly used for the right hand wrap as seen in FIG. 2. Further, for purposes of the description to follow, wrap 10 has the top edge 26 and the bottom edge 28.

Spaced inwardly from end 14, a length of covered padding 30 in the form of foam material or the like is secured to material 10 in any suitable manner such as by stitching 32 and is coextensive with the width thereof. To the top edge 26 of wrap 10 and within the longitudinal limits of pad 30 there are secured the spaced finger loops 34, 36, similar to loop 18, which project perpendicularly from edge 26 as shown. A second thumb loop 38 is secured to the bottom wrap edge 28 within the confines of pad 30 and is angularly disposed in a direction towards wrap end 16. Thumb loop 38 is spaced inwardly from thumb loop 18 and is substantially opposite to finger loop 36.

A fastening means 40 is applied to end 16 and while this can be in any suitable form of a strap, tie string or the like, I have preferably used the article known in the trade as Velcro since it is self-fastening, can be easily secured by the user with one hand and can be easily unfastened as is well known. Such fastening means 40 includes member 42 secured longitudinally and centrally of the outer side of wrap 10 extending inwardly from end 16 and an elongated fastening strap 44 secured at one end to end 16 in longitudinal alignment with member 42 as shown. With wrap 10 thus constructed and arranged as described, it is used as follows, reference being made more particularly to FIGS. 5-8 showing the wrap 10 in FIG. 1 being applied to a left hand 46.

The thumb loop 18 and end 14 is first engaged about the left thumb (FIG. 5) so that the inner side 24 of wrap 10 containing the letter "L" is face down in the palm of hand 46 which assures that the components of the fastening means 40 will be in proper relationship to each other to function as intended. Wrap 10 is then trained around the hand 46 at the base of the little finger so that the pad 30 can be trained across the back of the hand and over the knuckles toward the thumb. At this point, the hand is preferably turned over to top side as seen in FIG. 6 where finger loop 34, being the closest to the first thumb loop 18, is now positioned to be slipped over the little finger and finger loop 36 is positioned to be slipped over the index finger. The second thumb loop 38, being spaced from end 14 approximately the same distance as the index finger loop 36, is thus positioned on the bottom edge 28 to be slipped over the thumb together with loop 18 and together with loops 34, 36, loop 38 serves to secure the pad 30 in its proper place for continued wrappings. Additional finger loops may be provided if desired but loops for the little finger and index finger as described have worked very satisfactorily. The remainder of material 12 is then wrapped with the desired tension about the hand with intermediate turnings as desired encircling the wrist and terminating about the wrist where it is secured by fastening means 40 as seen in FIGS. 7 and 8. Thus arranged, wrap 10 will stay in place throughout use and adequately protect the knuckle area by the pad 30 which does not slip because of the arrangement of the finger and thumb loops.

For the right hand, wrap 10 in FIG. 2 is similarly applied and the only difference in the wraps in FIGS. 1 and 2 is the appropriate arrangements of the components of the fastening means 40 because of the reverse direction of wrapping. Either wrap 10 in FIGS. 1 and 2 could, if necessary, be used for either hand but this would require certain twisting of material to properly position fastening members 42,44 depending upon the hand being wrapped and, preferably, this inconvenience is avoided by the right and left arrangement shown.

Wrap 10 can be used both alone and with boxing gloves in training excercises and, of course, with the gloves in actual boxing contests. At all times, pad 30 protects the knuckles since it cannot slip and slide and when used with boxing gloves, provides a cushioned blow against an opponent which lessens the possibility of injury to such opponent.

One of the important advantages obtained by wrap 10 is found in its method of application where it is trained first from the thumb across the palm of the hand and then across the back of the hand for continued windings. This initial force on the thumb is in the direction of normal thumb movement so that the hand is comfortable and natural when wrapped and differs from the present widely used elongated single loop wrap referred to earlier which is consistently applied after attachment to the thumb by being first trained across the back of the hand and then across the palm. In such arrangement, the initial direction of force on the thumb is toward the back of the hand which is not a natural position of movement and is thus a disadvantage which the present invention eliminates. It can also be noted that wrap 10 with obvious rearrangements of the several loops and padding can serve as a protective wrapping for the foot and ankle. Accordingly, in view of the foregoing, it is thought a full understanding of the construction and operation of this invention will be had and the advantages of the same will be appreciated.

I claim:

1. A protective hand wrap for athletes, comprising:

an elongated strip of flexible material sufficient in length for multiple windings about the hand, knuckles and wrist of the user, said strip having a starting end and a fastening end, means on said starting end for engaging the thumb of a hand from which said strip is trained in multiple windings about the hand, knuckles and wrist to terminate in windings about the wrist, fastening means on said fastening end to secure said windings against accidental release, and independent finger encircling means on said strip between the ends.

2. A hand wrap as defined in claim 1 wherein said finger encircling means includes a pair of spaced finger encircling members adapted respectively for engagement with non adjacent fingers.

3. A hand wrap as defined in claim 2 wherein said encircling finger members engage the little finger and the index finger.

4. A hand wrap as defined in claims 1, 2 or 3 including a second thumb engaging means on said strip disposed in spaced relationship to said starting end at a point to be positionable for thumb engagement immediately after the first winding of said strip about the hand.

5. A hand wrap as defined in claim 1 including said finger encircling means being disposed on that portion of said strip to first traverse the knuckles of the hand.

6. A hand wrap as defined in claim 4 including a pad member secured to that portion of said strip to first traverse the knuckles of the hand.

7. A hand wrap as defined in claim 4 wherein said respective thumb engaging means and said finger encircling means are elastic loops.

8. A protective hand wrap for athletes, comprising:

an elongated strip of flexible material sufficient in length for multiple windings about the hand, knuckles and wrist of the user, said strip having a starting end, a fastening end, a top edge and a bottom edge, means on said starting end for engaging the thumb of a hand from which said strip is first trained across the palm of the hand, then about the base of the little finger across the back of the hand and knuckles and continues in multiple windings about the hand, knuckles and wrist to terminate in windings about the wrist, fastening means on said fastening end to secure said windings against accidental release, and finger encircling means secured to said top edge at a predetermined point thereon.

9. A hand wrap as defined in claim 8 where said finger encircling means includes a pair of spaced finger encircling members adapted respectively for engagement with non adjacent fingers.

10. A hand wrap as defined in claim 9 where said finger encircling members engage the little finger and the index finger.

11. A hand wrap as defined in claims 8, 9 or 10 including a second thumb engaging means on said bottom edge disposed in spaced relationship to said starting end at a point on said strip which completes the first winding across the back of the hand.

12. A hand wrap as defined in claim 11 including a pad member secured to that portion of said strip to first traverse the knuckles of the hand.

13. A hand wrap as defined in claim 11 wherein said respective thumb engaging means and said finger encircling means ar elastic loops.

14. A method of applying a protective wrapping in the form of an elongated strip of flexible material to a person's hand, comprising the steps of:

removably securing one end of said strip to the thumb, training said strip from the thumb first across the palm, then around the base of the little finger and across the back of the hand over the knuckles towards the thumb, respective mean on said strip when first in contact with the knuckles to encircle at least one finger and the thumb, continue winding said strip about the hand, knuckles and wrist to terminate in windings about the wrist, and fastening the other end of said strip against accidental release.

15. A method as defined in claim 14 including padding that portion of said strip which first engages the knuckles.

16. A method as defined in claim 14 including also securing said strip when first in contact with the knuckles to another non adjacent finger.

17. A method as defined in claim 16 wherein the non adjacent fingers are the little finger and the index finger.

18. A protective hand wrap for athletes, comprising:

an elongated strip of flexible material sufficient in length for multiple windings about the hand, knuckles and wrist of the user, said strip having a starting end and a fastening end, means on said starting end for engaging the thumb of a hand from which said strip is trained in multiple windings about the hand, knuckles and wrist to terminate in windings about the wrist, a second thumb engaging means on said strip disposed in spaced relationship to said starting end at a point to be positionable for thumb engagement immediately after the first winding of said strip about the hand, fastening means on said fastening end to secure said windings against accidental release, and finger encircling means on said strip at a predetermined point thereon.

19. A hand wrap as defined in claim 18 wherein said finger encircling means includes a pair of spaced finger encircling members adapted respectively for engagement with non adjacent fingers.

20. A hand wrap as defined in claim 19 wherein said finger encircling members engage the little finger and the index finger.

21. A hand wrap as defined in claim 18 including said finger encircling means being disposed on that portion of said strip to first traverse the knuckles of the hand.

22. A hand wrap as defined in claim 21 including a pad member secured to that portion of said strip to first traverse the knuckles of the hand.

23. A hand wrap as defined in claim 18 wherein said respective thumb engaging means and said finger encircling means are elastic loops.

* * * * *